United States Patent [19]

Shigeru et al.

[11] 4,447,501

[45] May 8, 1984

[54] CERAMIC BASED COMPOSITE MATERIAL FOR FLAME SPRAYING

[75] Inventors: Kitahara Shigeru, Ota; Isao Okane, Higashikurume; Katsuyuki Shirai, Meguro; Tosio Morimura, Kawaguchi, all of Japan

[73] Assignees: National Research Institute for Metals; Showa Denko Kabushiki Kaisha, both of Tokyo, Japan

[21] Appl. No.: 297,118

[22] Filed: Aug. 28, 1981

[30] Foreign Application Priority Data

Sep. 29, 1980 [JP] Japan ..... 55-134221

[51] Int. Cl.[3] ..... B22F 1/02

[52] U.S. Cl. ..... 428/570; 75/0.5 BC; 419/35; 428/937; 427/215; 427/217

[58] Field of Search ..... 427/215, 217, 423; 428/570, 937; 75/0.5 BC, 212

[56] References Cited

U.S. PATENT DOCUMENTS 3,552,995 1/1971 Powell .
3,914,507 10/1975 Fustukian .
3,920,410 11/1975 Kunda .
3,960,545 6/1976 Port .
4,068,038 1/1978 Montiglio .
4,330,575 5/1982 Litchfield .

*Primary Examiner*—Brooks H. Hunt
*Assistant Examiner*—Anne Brookes
*Attorney, Agent, or Firm*—McAulay, Fields, Fisher, Goldstein & Nissen

[57] ABSTRACT

In a composite material of metal and ceramic, the excellent properties of metal and ceramic are combined, so that, when the composite material is flame sprayed, a flame sprayed coating having good mechanical strength and heat- corrosion- and wear-resistance can be obtained. Conventional composite material, in which metal and ceramic are merely mixed or mechanically bonded with one another, cannot provide a plasma sprayed coating having a high bonding strength to the substrate. The present invention improves the plasma spraying composite material by means of a chemical bond between the metal and ceramic parts. The chemical bond may be a compound-or solid solution formation between these parts. The core of the composite material is $ZrO_2$ and the coating is a metal, metallic compound or combination thereof.

11 Claims, 2 Drawing Figures

CERAMIC BASED COMPOSITE MATERIAL FOR FLAME SPRAYING

The present invention relates to a flame spraying material, and more particularly to a ceramic based composite material for flame spraying.

The ceramic material has a superior property such as heat, corrosion- and wear-resistances, compared to that of metallic material and is increasingly used in many fields with the development of the working techniques of the ceramic material, such as flame spraying and powder metallurgy. However, these working techniques still involve problems in that the excellent properties of the ceramic material cannot be fully utilized in the articles produced by the flame spraying. Namely, the ceramic coating applied on a metallic substrate by the flame spraying process has a disadvantageously low bonding strength and density, with the result that, under the present circumstances, the application of the ceramic coating to the parts, in which high level of the wear-, corrosion- and heat-resistances is requested, is restricted.

The ceramic material for flame spraying has recently attracted attention in various fields of industry and has been used for the coating on a material which does not have satisfactory heat- and corrosion-resistance. For example, the metallic material of an internal combustion engine is used at the highest temperature where the strength and corrosion resistance of such material are satisfactory. In other words, internal combustion engines are operated under the maximum temperature where the conventional metallic material can reliably withstand the operational conditions from the point of view of strength and corrosion resistance. It is necessary to change the material of internal combustion engines, so that the engines can be operated at a higher temperature, which, as is well known, enhances the thermal efficiency of the engines.

The ceramic flame spraying material as compared with the known metallic material can provide a coating which has advantageously high heat resistance and low heat conduction but which has disadvantageously low ductility and toughness. The sprayed ceramic coating is, therefore, liable to effectively protect the substrate, on which the ceramic material is applied, and to prevent cracks, as compared with the metallic coating. The flame spraying ceramic material has such good heat- and corrosion-resistances that it can be applied for the coating of parts used at a high temperature, such as turbine blades. The sprayed ceramic material cannot, however, provide a flame sprayed coating which has enough mechanical strength and resistance against thermal shock for preventing cracking of the coating at high temperatures.

In order to overcome the disadvantages of the flame spraying ceramic material, it has been proposed to use a metal as the binder for the ceramic material and thus to form a strong flame sprayed coating, in which the ceramic particles are bonded to each other by the metallic binder. Spraying composite metal-ceramic materials include: a mixture of ceramic powder and metallic powder, in which those powders are merely mixed with each other; a ceramic powder with coated metal thereon; and, the sintered and then pulverized material, in which the sintered body of ceramic and metalic powders is pulverized as the spraying powder. It is difficult to uniformly disperse both powders in the ceramic and metallic powder mixture, and the individual powder particles are liable to redistribute non uniformly during spraying flight, with the consequence that the flame sprayed coating becomes a non uniform structure and is microscopically composed of the phase mixture of each component, i.e., the metal and ceramic materials. The metal-coated ceramic powder and the sintered and then pulverized composite material are devised to improve the ceramic and metal powder mixture.

IN THE DRAWINGS

FIG. 1 is a microscope photograph of a sprayed coating produced by means of the metal-plated ceramic material; and FIG. 2 is a microscope photograph stellar to FIG. 1 illustrating the cross-section of flame sprayed layer obtained by means of a plasma jet sprayed coating.

DESCRIPTION OF THE PRIOR ART

The prior art will now be explained with reference to FIG. 1.

In the drawings, FIG. 1 is a microscope photograph of a sprayed coating produced by means of the metal-plated ceramic material, and FIG. 2 is similar view to FIG. 1 and illustrates the cross-section of a flame sprayed layer obtained by means of the plasmajet sprayed coating according to the present invention.

According to research performed by the present inventors, the metal-coated ceramic powder, which is produced by plating the metal on the ceramic powder particle, also forms the flame sprayed coating which is microscopically composed of the phase mixture of the metal phase appearing white in FIG. 1 and the ceramic phase appearing somewhat blackish in FIG. 1, although the interface of metal and ceramic phases are not so clear as in the sprayed coating produced by the ceramic and metal powder mixture. This is believed to be due to of the fact that, during the spraying flight the metal film on the ceramic powder particle coagulates and the metal droplets so formed on the ceramic powder peel off and separate from the ceramic powder particle. The formation of metal droplets and the peeling off of the metal droplets from the ceramic material were confirmed by interrupting their spraying flight before the workpiece and then observing the captured and solidified particles with a microscope.

The sintered and then pulverized composite material causes a sprayed coating with a non uniform structure, because during pulverization the sintered body is highly liable to be divided into individual particles, in which the proportion of either metallic or ceramic phase is greater than the predetermined proportion and thus only a small amount of the particles has the predetermined proportion of metal parts to ceramic parts.

It is known from Japanese Published Patent Application No. 22521/1980 that a composite powder of metal oxide and metal is obtained by a process of mixing an easy to reduce metal oxide powder with a hard to reduce metal oxide powder, sintering the mixture, pulverizing and then treating the obtained powder in a reducing atmosphere in such a manner as to reduce the easy to reduce metal oxide. It is difficult in this process to entirely coat the metal oxide powder particle with the metallic material and hence to obtain a firm bonding between the metal oxide powder particle and the metal coating. If the composite powder is used as the flame spraying material, a uniform and dense flame sprayed coating cannot be obtained because of the weak bonding between the metal oxide powder particle and the plated metal.

It is an object of the present invention to remove the disadvantages of the known flame spraying composite materials, by means of firmly bonding the metallic layer onto the ceramic particles and preventing peeling off the deposited metallic layer from the ceramic particles during the spraying.

The present invention involves the discovery that the metallic part is peeled off during the spraying from the ceramic part of a composite spraying material due to a low bonding strength between the deposited metal and the ceramic surface, on which the deposited metallic coating is merely mechanically or physically applied or is only partly bonded.

In accordance with the objects of the present invention, there is provided a flame spraying composite material based on ceramic, characterized in that a coating, which consists of at least one member selected from the group consisting of metal and metallic compound, is firmly bonded over the entire surface of the ceramic particles by a chemical bond.

DETAILED DESCRIPTION OF THE INVENTION

Figure 1:
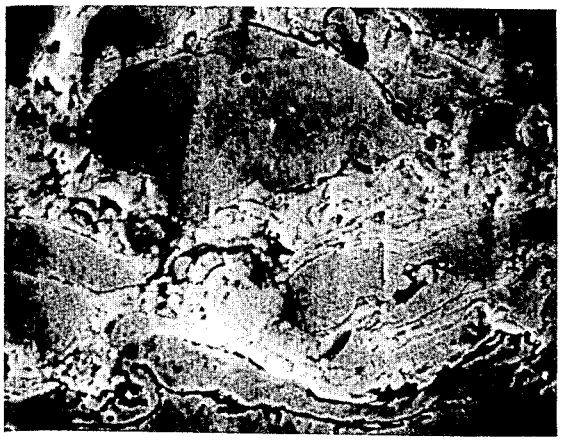

The present invention is hereinafter explained with regard to embodiments thereof.

The kinds of the ceramic particles are generally oxide particles such as $Al_2O_3$, $ZrO_2$, MgO, $MgO.Al_2O_3$, $Cr_2O_3$, $3SiO_2.2Al_2O_3$ and the like.

A nickel coating deposited on the ceramic particles, for example, $Al_2O_3$ particles, formed by an electroless plating, cannot provide a chemical bond nor a firm bonding strength between the $Al_2O_3$ and nickel. The conventional composite powder, of for example, nickel and $Al_2O_3$ produced by the electroless plating, is divided into metal and ceramic phases due to peeling off of the former phase from the ceramic particles during the spraying. The chemical bond between the ceramic particles and the metal and/or metallic compound layer includes, in addition to the bond between the molecules of a chemical compound, a bond between the atoms in the solid solution which is formed by diffusion. The kinds of ceramic and metal and/or metallic compound are so selected that the chemical bond is formed at the interface therebetween. When the coating layer and the ceramic are metal and metal oxide, respectively, the affinity of the metal to oxygen is desirably higher than that of the constituent metal of the metal oxide. When both deposited layer and ceramic particles are metallic compounds, both metallic compounds are so selected that upon heating the formation of solid a solution or a chemical compound easily takes place between both metallic compounds. The deposited layer may be a mixture of metal and a metallic compound.

The chemical bond ensures to strongly bond the deposited layer on the ceramic particles and hence to prevent the peeling off even during the spraying flight.

A preferable flame spraying composite material according to the present invention has the following structure. The deposited layer formed on the surface of the ceramic particles consists of a mixture of metal oxide and metal, which is a constituent of the metal oxide, except that: the interface of the deposited layer with the ceramic particles consists of the metal oxide; and, the outer surface of the deposited layer essentially consists only of the metal, the concentration of the metal in the deposited layer increasing continuously from the interface to the outer surface of deposited layer. The mixture mentioned above may be composed of at least one metal oxide and at least one metal. The mixture of two metal oxides and two metals can be, for example, a mixture of $NiO.Cr_2O_3$-Ni.Cr. The continuous concentration change of the metal realizes a continuous replacement of the metal oxide by metal toward the outer surface of the deposited layer and thus enhances the bonding strength of deposited layer, in which the ceramic particles, the metal oxide and the metal are successively bonded.

The ceramic particles may be comprised of nitride, such as $Si_3N_4$, AlN, TiN and BN, and carbide, such as SiC, WC, TiC and ZrC. The flame spraying composite material has desirably a particle size ranging from 1 to 88$\mu$ (microns). When the particle size of the composite flame spraying material is much smaller than 1$\mu$, it is difficult to supply the material into, for example, a spray torch, at a constant rate. On the other hand, when the particle size is much greater than 88$\mu$, the fusion of the material during spraying does not take place consistently and hence the density of flame sprayed coating is inferior.

Desirably, the metal and metallic compound used in the deposited layer are heat-and corrosion-resistant. The metal may be nickel (Ni), chromium (Cr), cobalt (Co), aluminum (Al), silicon (Si), boron (B), molybdenum (Mo), tantalum (Ta), niobium (Nb), yttrium (Y), hafnium (Hf), beryllium (Be), titanium (Ti), iron (Fe), tungsten (W), silver (Ag), copper (Cu), zirconium (Zr), vanadium (V) and the like in either elemental form or alloy form of one or more of these elements. The metal may contain an additional metal which is incorporated into one of the above metals in an amount not imparing the heat-and corrosion-resistance of the above metals. For example, an alloy of Cr-Al and the like can be used for the metallic part of the flame spraying composite material. The metallic compound of the deposited layer may be $TiO_2$, $SiO_2$, CaO, MgO, $Cr_2O_3$, $3Al_2O_3.2SiO_2$, $MgO.Al_2O_3$, $Fe_2O_3$, and the like.

A desirable proportion of the deposited layer to the ceramic particle depends on the constituent material of the deposited layer and the conditions, under which the flame sprayed parts are used. When the deposited layer consists of an oxide, the proportion mentioned above is not specifically limited. On the other hand, when the deposited layer comprises a metal, the proportion mentioned above should neither be so small that strength or resistance against cracking of the flame sprayed coating is unsatisfactory nor so large that the heat-and corrosion-resistance, which is a characteristic of the ceramic particles, is imparted. In this sense, the proportion of the metal-containing deposited layer to the ceramic particles should be so controlled that the proportion of the metal in the flame spraying composite material does not exceed 50% by weight and desirably ranges from 2 to 50% by weight. When the flame sprayed parts are used under such a high temperature, as when turbine blades are used, the metal proportion should range from 2 to 30% by weight.

Preferable combinations of ceramic-metal compound of the deposited layer-metal of the coating layer are: $Al_2O_3$-$NiO.Cr_2O_3$-Ni.Cr; $Al_2O_3$-NiO-Ni; $Al_2O_3$-$Cr_2O_3$-Ni.Cr; $ZrO_2$-NiO-Ni.Cr; $Al_2O_3$-$Cr_2O_3$-Cr.Al; $Al_2O_3$-$SiO_2$-Ni.Cr; $Si_3N_4$-$SiO_2.Si_3N_4$-Ni.Cr; and, SiC-$SiO_2$.-SiC-Ni.Cr. In the above combinations, a mixed phase between the metal of the deposited layer and the oxide of the deposited layer and ceramic is formed at the interface between the metal and the oxide.

The process for producing the flame spraying composite material will now be explained.

When the ceramic material is fusible, such as $Al_2O_3$, MgO and the like, the fused and then solidified ceramic material is pulverized so as to obtain ceramic particles. Alternately, commercially available baked products, such as alumina by Bayer's process and baked magnesia, may be pulverized. In addition, the carbide and nitride ceramic particles may be obtained by carbonizing or nitrifying the corresponding oxides and then pulverizing the resultant product.

On the resultant ceramic particles, metallic compound or metal is applied by the following procedure. As the metallic compound, $NiCl_2$, $CrCl_3$, $SiCl_4$, $Ni(NO_3)_2$, $Al_2O_3$, $Cr_2O_3$, NiO and the like can be mentioned. A liquid form metallic compound can be used for the application, when the metallic compound is dissolvable in a solvent. In order to apply the liquid form metallic compound on the ceramic particles, the ceramic particles are immersed in the solution of this compound and the solvent is vaporized.

A hard to dissolve metallic compound, such as carbide, is applied on the ceramic particles by cohesion. The metal which is, upon heating, capable of forming a chemical bond with the ceramic, can be directly applied on the ceramic particles by, for example, an electroless plating, followed by heating thereby forming the chemical bond between the metal and the ceramic. A mixture of metal compound and metal can be applied on the ceramic particles by using a plating solution, in which compounds which are easy to reduce and hard to reduce, respectively, are suspended. As a result of the plating, the mixture of the metal, which is easy to reduce, and the compound of metal, which is hard to reduce, is deposited on the ceramic particles. In the above described procedures for the application of the deposited layer, one or more metal or metal compound can be applied in the mixture or composite form on the ceramic particles.

The chemical bond between the deposited layer and the ceramic particles is formed after the application mentioned above. The ceramic particles with the applied layer are heated to such a temperature that a solid solution or a chemical compound is formed at the interface between the ceramic particles and the deposited layer. The temperature for forming the chemical compound largely depends on what kinds of ceramic material and coating material are combined with one another in the flame spraying composite material. When the ceramic material is comprised of oxide and the coating material is one of those mentioned above, the heating temperature is selected in the range of from 500° to 1500° C. When the ceramic material is comprised of carbide or nitride, the heating temperature should be higher than in the case of the oxide ceramic material. The heating temperature is also dependent upon the heat resistance of metal, and should be enhanced when the heat resistance is high.

A heating atmosphere should be selected so as to enhance the bonding strength. When the metal compound is a chloride, the heating atmosphere is desirably an oxidizing one, so that the chloride is converted to an oxide during heating in the atmosphere. In the case where a part or a major part of the metal oxide applied onto the ceramic particles is to be reduced so as to convert the metal oxide to metal, the heating atmosphere should contain a reducing gas which can reduce the corresponding metal oxide. An example of the reducing atmosphere is an $H_2$ atmosphere. During the reduction of the metal oxide in the reducing atmosphere, the reduction proceeds from the outer part toward the inner part of the deposited layer. Therefore, it is possible, by adjusting the reduction degree of the deposited layer, to adjust the metal concentration at a given depth of the deposited layer and also to realize such a metal concentration profile decreasing continuously in the direction toward that of the surface of deposited layer which essentially consists of metal and further at the interface between the deposited layer and the ceramic particles the metal oxide is a major constituent material.

The present invention is explained hereinafter by way of examples.

EXAMPLE 1

An electrofused alumina ($Al_2O_3$) is pulverized to powder having a grain size of from 10 to 74μ. 174 parts by weight of a 10 wt.% $NiCl_2$ solution was added to and stirred uniformly with 100 parts by weight of the electrofused alumina, followed by heating to 105° C. so as to evaporate the water to dryness. The resultant powder, which was lightly coagulated, was crushed and then heated in air at 650° C. for 90 minutes. In the resultant powder, an NiO layer was bonded by sintering it to the $Al_2O_3$ particles over the entire surface of the $Al_2O_3$ particles and the NiO layer amounted to about 10% by weight. $NiCl_2$ was almost completely converted to NiO. The bonding part of the NiO layer with the $Al_2O_3$ particles was observed by an X-ray diffraction device which proved that a chemical bond due to the solid solution was formed at the bonding part.

The resultant composite powder material and the comparative powder materials and the comparative powder materials were used for flame spraying on a heat resistant substrate made of nickel. The flame spraying was carried out with the aid of a plasma jet which was generated by an argon arc. The comparative powder materials were $Al_2O_3$ alone and the mixture of $Al_2O_3$ powder with 10% NiO. The results of flame spraying are given in Table 1.

TABLE 1

| Flame Spraying Material | Properties of Flame Sprayed Film | |
|---|---|---|
| | Bonding Strength (MPa) | Porosity (%) |
| $Al_2O_3$ alone (Comparison) | 12.8 | 6.5 |
| $Al_2O_3$ + 10% NiO mixture (Comparison) | 14.5 | 5.6 |
| $Al_2O_3$ – 10% NiO coating (Invention) | 20.6 | 4.2 |

EXAMPLE 2

The procedure of Example 1 was repeated except that instead of $Al_2O_3$ powder a $ZrO_2$ powder stabilized by $Y_2O_3$ was used as the ceramic particles. The $ZrO_2$ powder was prepared by pulverizing a commercially available powder to a grain size of from 10 to 74μ. The results of flame spraying are given in Table 2.

TABLE 2

| Flame Spraying Material | Bonding Strength (MPa) | Porosity (%) |
|---|---|---|
| $ZrO_2$ alone | 10.8 | 8.1 |
| $ZrO_2$ + 10% NiO Mixture | 17.2 | 6.5 |
| $ZrO_2$ — 10% NiO coating | 26.5 | 3.3 |

EXAMPLE 3

The resultant composite material powder in Example 1, i.e., the 10% NiO-coated $Al_2O_3$ powder, was treated within an $H_2$ stream at a temperature range of from 950° to 1100° C., thereby partly reducing the NiO material at the surface of this powder to metallic nickel. The resultant particles comprised $Al_2O_3$ (interior), NiO (intermediate) and Ni (surface). The average molar proportion of NiO to Ni at the whole coating layer of the particles was about 2:8, and the Ni concentration was higher at the outer part of coating layer.

A comparative flame spraying material was prepared by mixing the $Al_2O_3$, NiO and Ni powders with each other so that the proportion of those powders corresponded to that of the above resultant composite powder. The comparative material is not a composite material but a mere mixture. The results of flame spraying are given in Table 3.

TABLE 3

| Flame Spraying Material | Bonding Strength (MPa) | Porosity (%) |
|---|---|---|
| Invention | 24.0 | 3.8 |
| Comparison | 14.5 | 5.6 |

EXAMPLE 4

443 parts by weight of an aqueous $NiCl_2$ solution (10% by weight) and 153 parts by weight of an aqueous solution of $CrCl_3$ were added to and thoroughly stirred with 100 parts by weight of either $Al_2O_3$ mentioned in Example 1 or $ZrO_2$ mentioned in Example 3, followed by vaporizing the water to dryness. The resultant powder was subjected to a two stage treatment in air at a temperature range of from about 500° to 1500° C., thereby converting the chloride to oxide and then sintering the powder. By sintering, $Cr_2O_3$ and NiO were bonded to the $Al_2O_3$ or $ZrO_2$ particles. An observation of the bonding surface by an X-ray diffraction device revealed that the $Al_2O_3$ and $ZrO_2$ phases were chemically bonded to the $Cr_2O_3$ and NiO phases by the formation of a solid solution between a part of these phases. The resultant composite powders with a chemically bonded coating layer were treated in an $H_2$ stream at a temperature range of from 1200° to 1500° C., and as a result of the treatment a part of $Cr_2O_3$ and a major part of NiO were reduced and converted to metals. The metals were present at a large proportion particularly on the surface of the coating layer and a larger amount of metal oxides were present at an inner part of the coating layer. The approximate composition of the composite powder materials was 79% of $Al_2O_3(ZrO_2)$, 2% of NiO, 3% $Cr_2O_3$, 14% of Ni and 2% of Cr, the percentage being by weight.

The composite powders for the comparison purpose were prepared by plating electrolytically and an electroless manner Ni and Cr on the particles having a composition of either $Al_2O_3$-NiO.$Cr_2O_3$ or $ZrO_2$-NiO-$Cr_2O_3$. These powders had the same composition as the composite powder of the present invention but were produced by a mere plating. The results of the flame spraying are given in Table 4.

TABLE 4

| Flame Spraying Material (Kind of Ceramic) | Bonding Strength (MPa) | Porosity (%) |
|---|---|---|
| $Al_2O_3$ (invention) | 26.0 | 3.5 |
| $Al_2O_3$ (comparison) | 20.0 | 4.1 |
| $ZrO_2$ (invention) | 30.5 | 3.1 |
| $ZrO_2$ (comparison) | 25.0 | 3.5 |

Figure 2:
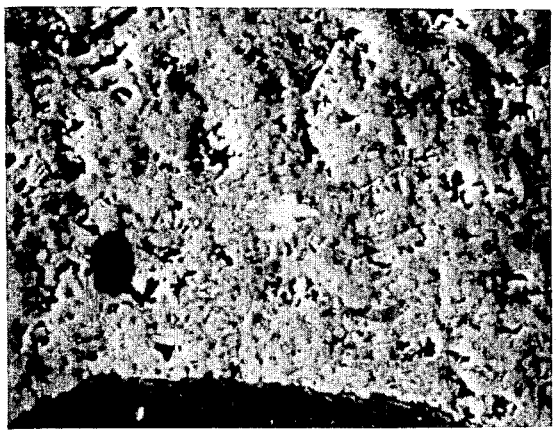

The microscope structure of the flame sprayed coating by the $ZrO_2$ composite material according to the present invention is given in FIG. 2. It will be apparent that the structure of the plasma sprayed coating shown in FIG. 2 is more dense and uniform than in FIG. 1.

We claim:

1. A flame spraying composite material consisting of core particles which essentially consist of $ZrO_2$ and a deposited coating layer which is firmly bonded over the entire surface of the $ZrO_2$ particles by a chemical bond, wherein said deposited layer comprises a metal oxide and a metal which is a constituent of said metal oxide, an interface of said deposited layer with said $ZrO_2$ particles consisting of said metal oxide whch is a major constituent material, and an outer surface of said deposited layer which essentially consists of said metal.

2. A flame spraying composite material according to claim 1, wherein said metal is at least one member selected from the group consisting of Ni and Cr.

3. A flame spraying composite material according to claim 1, wherein said metal is in an alloy form containing at least one member selected from the group consisting of Ni and Cr.

4. A flame spraying composite material according to claim 1, wherein said $ZrO_2$ is stabilized by $Y_2O_3$.

5. A flame spraying composite material according to claim 1, wherein the concentration of said metal increases continuously from the interface to the outer surface of said deposited coating layer.

6. A flame spraying composite material according to claim 2, wherein said deposited layer is NiO-Ni.Cr.

7. A flame spraying composite material consisting of core particles which essentially consist of $ZrO_2$ and a deposited coating layer which is firmly bonded over the entire surface of the $ZrO_2$ particles by a chemical bond, wherein said deposited layer comprises a metal oxide and a metal which is a constituent of said metal oxide, and an interface of said deposited layer with said $ZrO_2$ particles which consists of said metal oxide, and an outer surface of said deposited layer only which consists of said metal, the concentration of said metal increasing continuously from the interface to the outer surface of said deposited coating layer.

8. A flame spraying composite material according to claim 7, wherein said metal is at least one member selected from the group consisting of Ni and Cr.

9. A flame spraying composite material according to claim 7, wherein said metal is in an alloy form containing at least one member selected from the group consisting of Ni and Cr.

10. A flame spraying composite material according to claim 7, wherein said $ZrO_2$ is stabilized by $Y_2O_3$.

11. A flame spraying composite material according to claim 7, wherein said deposited layer is NiO-Ni.Cr.

* * * * *

UNITED STATES PATENT AND TRADEMARK OFFICE

CERTIFICATE OF CORRECTION

PATENT NO. : 4,447,501

DATED : May 8, 1984

INVENTOR(S) : Shigeru et al

It is certified that error appears in the above-identified patent and that said Letters Patent is hereby corrected as shown below:

On the title page Item (75) Inventor should read

-- Shigeru Kitahara --.

Signed and Sealed this

*Twenty-sixth* Day of *February 1985*

[SEAL]

*Attest:*

DONALD J. QUIGG

*Attesting Officer*

*Acting Commissioner of Patents and Trademarks*